US008327568B1

(12) United States Patent
Lavergne et al.

(10) Patent No.: US 8,327,568 B1
(45) Date of Patent: Dec. 11, 2012

(54) GUNSTOCK SYSTEM HAVING AN INTERNAL MAGAZINE

(76) Inventors: Michael D. Lavergne, Bush, LA (US); Daniel L. Knezha, Mobile, AL (US)

( * ) Notice: Subject to any disclaimer, the term of this patent is extended or adjusted under 35 U.S.C. 154(b) by 106 days.

(21) Appl. No.: 13/085,027

(22) Filed: Apr. 12, 2011

Related U.S. Application Data

(60) Provisional application No. 61/342,921, filed on Apr. 21, 2010.

(51) Int. Cl.
*F41C 23/22* (2006.01)

(52) U.S. Cl. ..... 42/71.01; 42/72; 42/90

(58) Field of Classification Search ..... 42/71.01, 42/72, 85, 90; 89/1.42
See application file for complete search history.

(56) References Cited

U.S. PATENT DOCUMENTS

| | | | | | |
|---|---|---|---|---|---|
| 458,824 | A | * | 9/1891 | Daudeteau | 42/21 |
| 711,989 | A | * | 10/1902 | Marble | 42/6 |
| 919,641 | A | | 4/1909 | Rodgers | |
| 922,173 | A | * | 5/1909 | Lovelace | 89/139 |
| 931,766 | A | * | 8/1909 | Kennedy | 42/71.01 |
| 939,707 | A | * | 11/1909 | Kennedy | 42/71.01 |
| 950,515 | A | * | 3/1910 | Rodgers | 42/71.01 |
| 1,031,428 | A | * | 7/1912 | D'Ubaldo | 42/17 |
| 1,051,960 | A | * | 2/1913 | Kennedy | 42/71.01 |
| 1,099,992 | A | | 6/1914 | Micke | |
| 1,110,209 | A | * | 9/1914 | Kirchner | 42/71.01 |
| 1,517,420 | A | | 12/1924 | Fritz | |
| 1,526,847 | A | | 2/1925 | Fritz | |
| 1,693,289 | A | * | 11/1928 | Warren | 42/71.01 |
| 2,476,355 | A | | 7/1949 | Brown | |
| 2,482,398 | A | | 9/1949 | Blanton | |
| 2,763,951 | A | * | 9/1956 | Harvey | 42/71.01 |
| 3,638,344 | A | | 2/1972 | Wagner | |
| D286,669 | S | | 11/1986 | Ballard | |
| 4,850,127 | A | | 7/1989 | Davis | |
| 5,048,214 | A | | 9/1991 | Cohen | |
| 5,225,613 | A | | 7/1993 | Claridge | |
| 5,755,055 | A | * | 5/1998 | Thompson et al. | 42/71.01 |
| 5,813,157 | A | | 9/1998 | Scott | |
| 6,829,855 | B2 | | 12/2004 | Seifert | |
| 6,952,896 | B2 | | 10/2005 | Davis | |
| 7,503,137 | B2 | | 3/2009 | Filicietti | |
| 7,805,873 | B2 | * | 10/2010 | Bentley | 42/74 |
| 7,937,873 | B2 | * | 5/2011 | Keng | 42/71.01 |
| 2004/0060220 | A1 | * | 4/2004 | Peddie | 42/71.01 |
| 2008/0190004 | A1 | * | 8/2008 | Filicietti | 42/71.01 |

OTHER PUBLICATIONS http://mossberg500.net/accessories/mossberg-500-stock-wshell-holder.html; Mossberg 500 Parts & Accessories; 2011.

(Continued)

*Primary Examiner* — Bret Hayes
*Assistant Examiner* — Joshua Freeman
(74) *Attorney, Agent, or Firm* — Neustel Law Offices

(57) ABSTRACT

A gunstock system having an internal magazine for storage of ammunition cartridges and for providing ambidextrous delivery of the ammunition cartridges. The gunstock has a vertically-oriented internal magazine having an upper opening and a lower reload/discharge opening, an operable cover for closing the upper opening, a biasing element, such as a spring, extending from the cover within the internal magazine to apply downward pressure upon the ammunition cartridges, and biased-retaining arms for operatively opening and closing the reload/discharge opening to permit and restrict removal of the ammunition cartridges from the internal magazine. The ammunition cartridges exit the reload/discharge opening in a forward manner and along the bottom of the gunstock. The gunstock has a bore extending therethrough from a rearward to a forward end of the gunstock for receiving a bolt to secure the gunstock to the receiver or adjacent portion of the firearm.

20 Claims, 4 Drawing Sheets

OTHER PUBLICATIONS http://www.riflestock.com/; Choate Machine & Tool, Inc.; 2011.
http://www.atigunstocks.com/c-28-shotshell-holders.aspx; Advanced Technology International; 2011.
http://www.allencompany.net/gun-accessories/shell-holders/buttstock-holders-1.html; Allen Company; 2011.
http://www.speedfeedinc.com/productsmain.html; SpeedFeed; 2011.
http://www.rossiusa.com/product-details.cfm?id=166&category=10&toggle=&breadcrumbseriesl; Rossi; 2011.

* cited by examiner

GUNSTOCK SYSTEM HAVING AN INTERNAL MAGAZINE

CROSS REFERENCE TO RELATED APPLICATIONS

I hereby claim benefit under Title 35, United States Code, Section 119(e) of U.S. provisional patent application Ser. No. 61/342,921 filed Apr. 21, 2010. The 61/342,921 application is currently pending. The 61/342,921 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a firearm and more specifically it relates to a gunstock system having an internal magazine for storage of various types of ammunition and for providing ambidextrous delivery of the ammunition into the user's hand when desired.

2. Description of the Related Art

Any discussion of the related art throughout the specification should in no way be considered as an admission that such related art is widely known or forms part of common general knowledge in the field.

Many firearms include a magazine, such as for holding one or more spare ammunition cartridges. However, the space allotted within the magazine is generally not suitable or adequate for holding a desired number of ammunition cartridges.

Attempts have been made to provide for a space to hold additional cartridges. Such attempts have included sleeves having holders for a plurality of cartridges, wherein the sleeve is removably received by the gunstock. However, the sleeves are generally not aesthetically pleasing, may not adequately hold the cartridges, may provide difficulty in removing the cartridges, may provide for uncomfortable shooting of the firearm, among other faults.

Other cartridge holders have been integrated into the gunstock; however these also have many faults, such as being difficult to remove the cartridges, making the firearm unbalanced, not aesthetically pleasing, not suited for left or right handed shooters, among various other deficiencies.

Because of the inherent problems with the related art, there is a need for a new and improved gunstock system having an internal magazine for storage of various types of ammunition and for providing ambidextrous delivery of the ammunition into the user's hand when desired.

BRIEF SUMMARY OF THE INVENTION

A system for storage of various types of ammunition and for providing ambidextrous delivery of the ammunition to the user. The invention generally relates to a firearm which includes a gunstock having a vertically-oriented internal magazine having an upper opening and a lower reload/discharge opening, an operable cover for closing the upper opening, a biasing element, such as a spring, extending from the cover within the internal magazine to apply downward pressure upon the ammunition cartridges, and biased-retaining arms for operatively opening and closing the reload/discharge opening to permit and restrict removal of the ammunition cartridges from the internal magazine. The ammunition cartridges exit the reload/discharge opening in a forward manner and along the bottom of the gunstock. The gunstock has a bore extending therethrough from a rearward to a forward end of the gunstock for receiving a bolt to secure the gunstock to the receiver or adjacent portion of the firearm.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
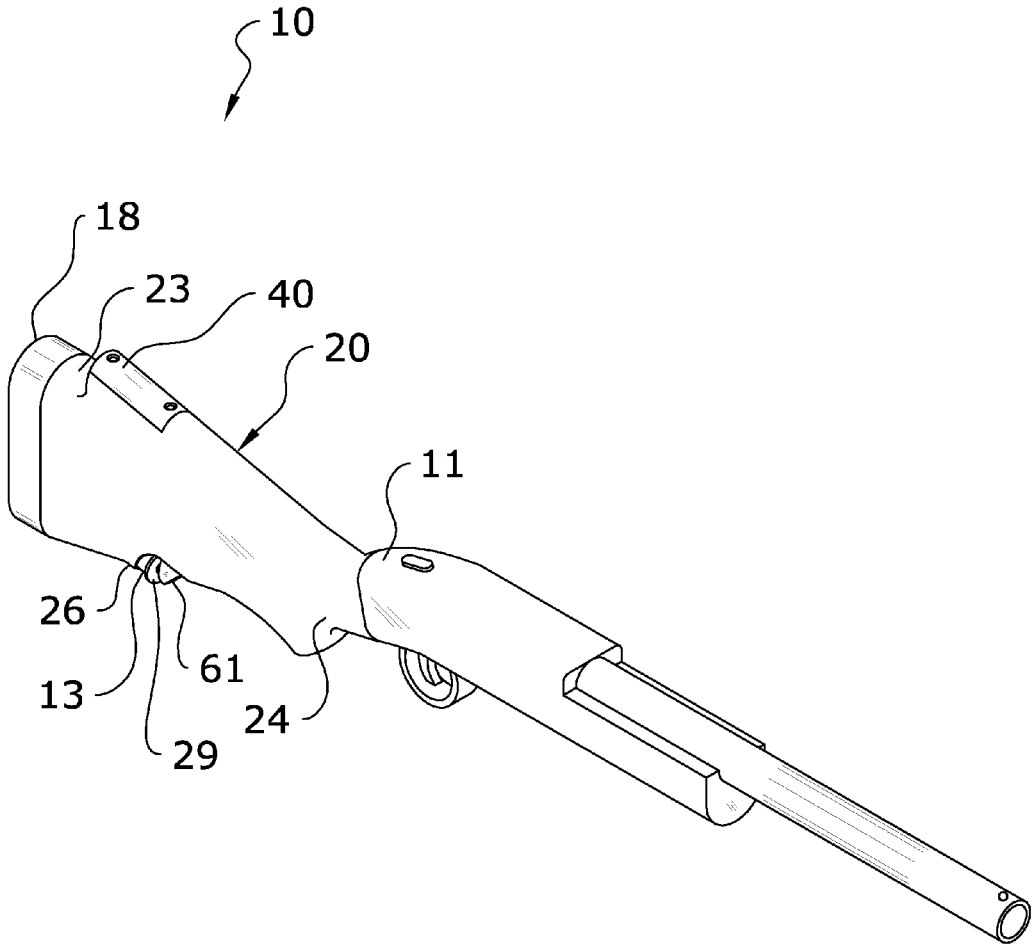
FIG. 1 is an upper perspective view of the present invention.
Figure 2:
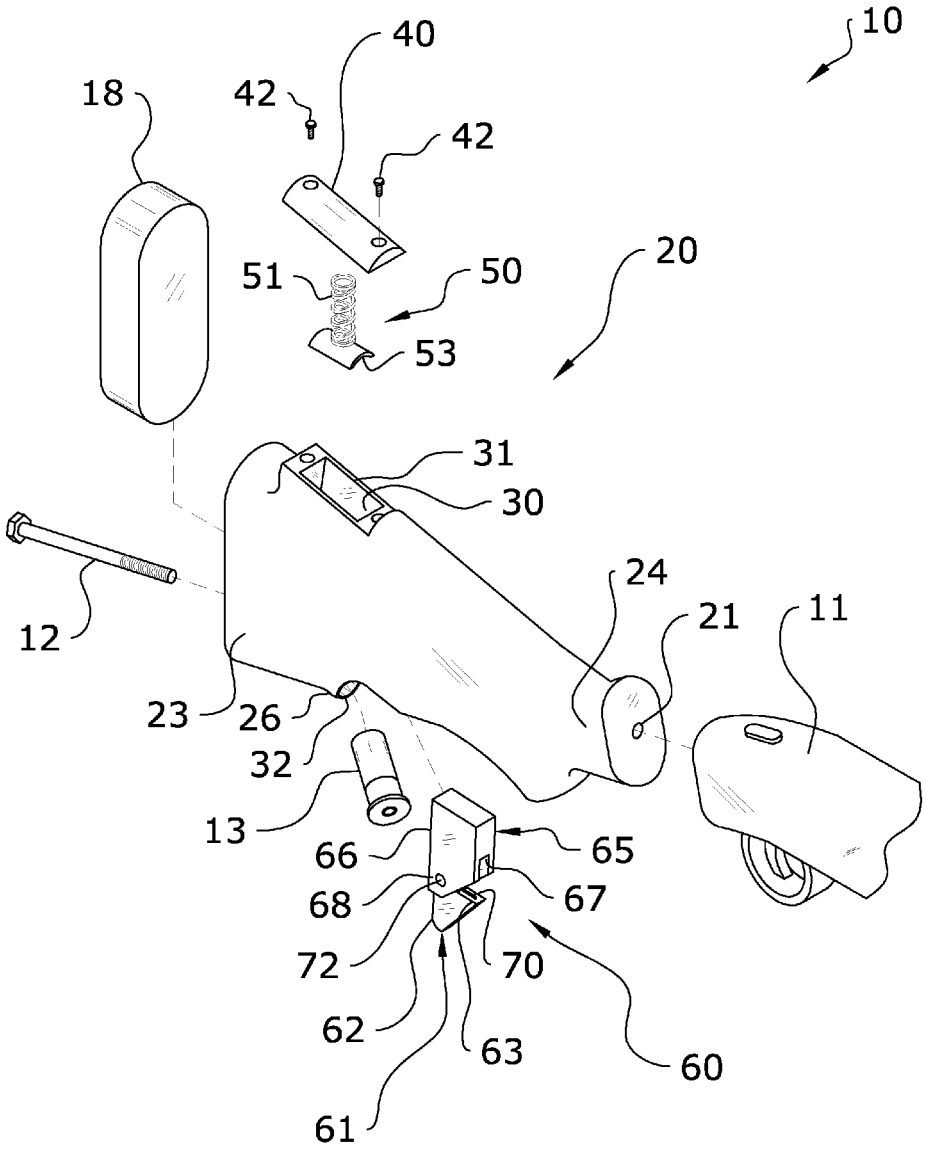
FIG. 2 is an exploded upper perspective view of the present invention.

A. Overview.

Turning now descriptively to the drawings, in which similar reference characters denote similar elements throughout the several views, FIGS. 1 through 6 illustrate a gunstock system having an internal magazine 10, which comprises a gunstock 20 having a vertically-oriented internal magazine 30 having an upper opening 31 and a lower reload/discharge opening 32, an operable cover 40 for closing the opening 31, a first biasing element 51, such as a spring, extending from the cover 40 within the internal magazine 30 to apply downward pressure upon the ammunition cartridges 13-16, and biased-retaining arms 61, 65 for operatively opening and closing the reload/discharge opening 32 to permit and restrict removal of the ammunition cartridges 13-16 from the internal magazine 30. The ammunition cartridges 13-16 exit the reload/discharge opening 32 in a forward manner and along the bottom of the gunstock 20. The gunstock 20 has a bore 21 extending therethrough from a rearward to a forward end of the gunstock 20 for receiving a bolt 12 to secure the gunstock 20 to the receiver or adjacent portion 11 of the firearm. Although not numbered, extending from the receiver 11 is also a barrel, trigger, chamber, and other elements of a conventional firearm.

It is appreciated that four ammunition cartridges 13-16 are described and illustrated as being contained within the magazine 30, however the magazine 30 may be sized to receive more or less cartridges and more or less cartridges may be present in the magazine 30 at any one time. Further, the number of ammunition cartridges described and shown herein is just for exemplary purposes. Additionally, although shotgun ammunition cartridges are shown, the present invention is equally suited for holding rifle ammunition cartridges.

B. Gunstock.

The gunstock 20 is suitable for being secured to various firearms and thus may be configured in a variety of sizes and shapes. The gunstock 20 may be of a plastic-synthetic type, wood material, or other. The gunstock 20 also may be retrofitted to an existing firearm or manufactured with a new firearm. The gunstock 20 preferably includes a bore 21 extending through the length of the gunstock 20 for aligning with a bore 21 of the receiver or adjacent portion 11 of the firearm to collectively receive an elongated bolt 12 or other type of fastener for securing the gunstock 20 to the receiver or adjacent portion 11 of the firearm. The bolt 12 generally has exterior threads or other securing means for connecting to the receiver 11. The bore 21 also generally has a shoulder 22 or other structure to retain the head of the bolt 12 within the gunstock 20 yet permit at least a portion of the shaft of the bolt 12 to enter a bore of the receiver 11 for connecting thereto. The gunstock 20 may also be formed of an integral part or two halves.

The gunstock 20 has a rear portion 23 and a front portion 24, with the rear portion 23 having the internal magazine 30 and the front portion 24 abutting the adjacent portion or receiver 11 of the firearm. The internal magazine 30 generally vertically extends with the rear portion 23 of the gunstock 20 from an upper end to a lower end of the gunstock 20 so that the ammunition cartridges 13-16 are substantially horizontally oriented and vertically-stacked within the internal magazine 30. The internal magazine 30 also generally angled slightly rearwardly so that the forward end of the ammunition cartridges 13-16 angles downwardly for providing ease in ejecting the ammunition cartridges 13-16. The magazine 30 is generally fully enclosed except for exposed portion 29 thus keeping the ammunition cartridges 13-16 substantially free from contact with foreign elements.

The gunstock 20 includes a lower support 26 which extends substantially from the rearward to the forward end of the lower end of the internal magazine 30, wherein the lowermost ammunition cartridge 13 is supported by the lower support 26. Because the bottom of the internal magazine 30 is covered via the lower support 26, the reload/discharge opening 32 of the magazine 30 is located at the forward side of the lower end of the magazine 30 so that the ammunition cartridges 13-16 are ejected forwardly at the bottom of the rear portion of the gunstock 20. A cavity 27 is also located within the gunstock 20 forwardly of the reload/discharge opening 32 and along the bottom of the gunstock 20 to provide adequate space for the second biasing assembly 60 to move and for the user to remove the ammunition cartridges 13-16.

Although the internal magazine 30 may be incorporated into the gunstock 20, the internal magazine 30 is preferably defined via a hollow casing having front, back, first side, and second side walls, as well as a partial bottom that follows the lower support 26.

It is appreciated that the gunstock 20 may also have a recoil pad or back plate 18 secured to the rearward end of the rear portion 23 of the gunstock 20. The recoil pad or back plate 18 generally extends over the rear, access opening of the bore 21 such as to cover and conceal the rear, access opening of the bore 21. The recoil pad or back plate 18 may be secured to the gunstock 20 via using various types of fasteners (not shown).

C. Top Cover.

The top cover 40 is used to close the upper opening 31 of the magazine 30. The top cover 40 may be secured to the gunstock 20 over the opening 31 in various manners, such as being secured via fasteners 42, a hinged connection, etc. Preferably the top cover 40 is easily opened and closed such as to permit an operator of the firearm to have convenient access to the magazine 30 to access internal components to clean or repair. In addition, the opening 31 is used by the manufacturer for installing necessary components. The top cover 40 is also generally flush with the gunstock 20 such as to be substantially inconspicuous.

D. First Biasing Assembly.

The first biasing assembly 50 preferably extends from the top cover 40 such as to extend downwardly within the magazine 30 for applying a biasing, downward force upon the ammunition cartridges 13-16 within the magazine 30. The preferred biasing assembly 50 is comprised of a first biasing element 51, such as a spring, and a follower element 53 secured to the end of the first biasing element 51 for maintaining constant contact with the uppermost ammunition cartridge 16 within the magazine 30, wherein the contacting surface area of the follower element 53 is sized much larger than the terminal end of the first biasing element 51.

The follower element 53 is adapted to disperse the downward force from the first biasing element 51 along the length of the ammunition cartridge 16 such as to ensure a constant downward force is applied to the ammunition cartridge 16 in the direction with and parallel to the lengthwise axis of the magazine 30. It is appreciated that alternate configurations of the first biasing assembly 50 may be appreciated and the first biasing element 51 may be comprised of other types of biasing structures.

E. Second Biasing Assembly.

The second biasing assembly 60 is to permit for opening and closing of the reload/discharge opening 32. The second biasing assembly 60 is supported by the gunstock 20 within the cavity 27 and forms the forward wall of the lower end of the magazine 30 such that the forward end of the lower ammunition cartridges 13-15 rest upon the second biasing assembly 60. The second biasing assembly 60 generally includes a lower retaining arm 61, an upper retaining arm 65 and a second biasing element 70 interconnecting the lower retaining arm 61 and the upper retaining arm 65.

Both of the dynamic lower retaining arm 61 and the dynamic upper retaining arm 65 are pivotally attached and both the lower retaining arm 61 and the upper retaining arm 65 apply pressure upon the second biasing element 70 when pivoted. In particular, the second biasing element 70 is preferably comprised of a tension spring that is supported via a pin 72 and as the lower retaining arm 61 is pivoted upwardly, the second biasing element 70 compresses. Likewise, as the upper retaining arm 65 is pivoted downwardly, the second biasing element 70 also compresses.

The lower retaining arm 61 covers the reload/discharge opening 32 when in the relaxed or substantially non-compressed state of the second biasing element 70. When the lower retaining arm 61 is pivoted forwardly and upwardly within the cavity 27, the reload/discharge opening 32 is uncovered thus permitting the operator to remove the lowermost ammunition cartridge 13. The upper retaining arm 65 is for ensuring that the lower retaining arm 61 does not move forwardly and upwardly after shooting the firearm due to the recoil force of the firearm. The upper retaining arm 65 applies pressure upon the lower retaining arm 61 such as to retain the lower retaining arm 61 in the closed position so that the ammunition cartridges 13-16 are retained in the magazine 30 at all times unless the lower retaining arm 61 is manually adjusted.

Figure 3:
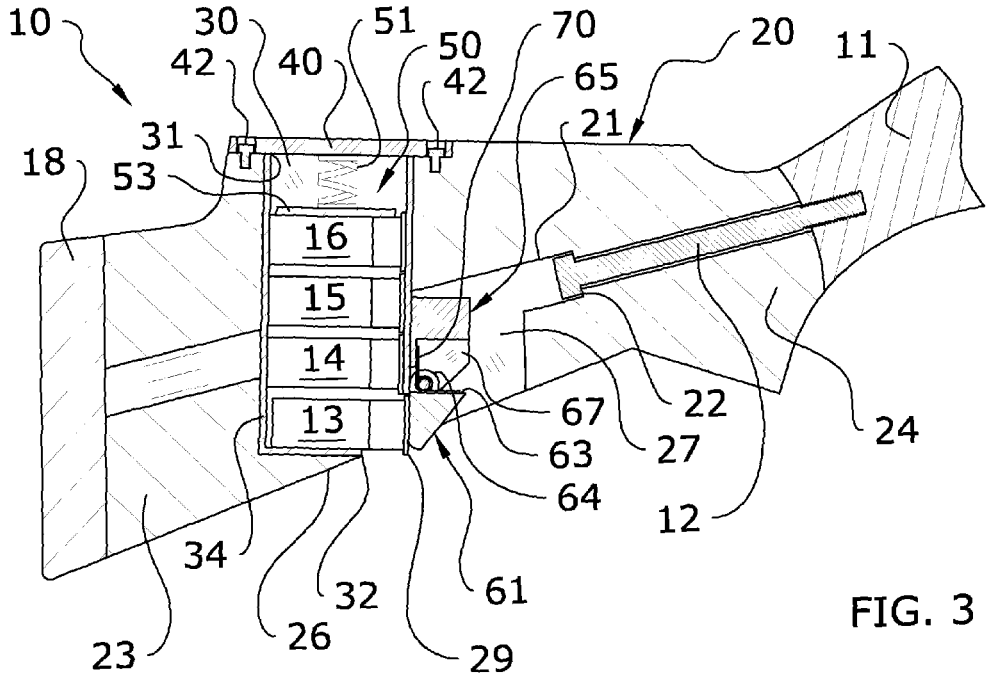
FIG. 3 is a sectional view of the present invention showing internally contained ammunition cartridges.
Figure 5:
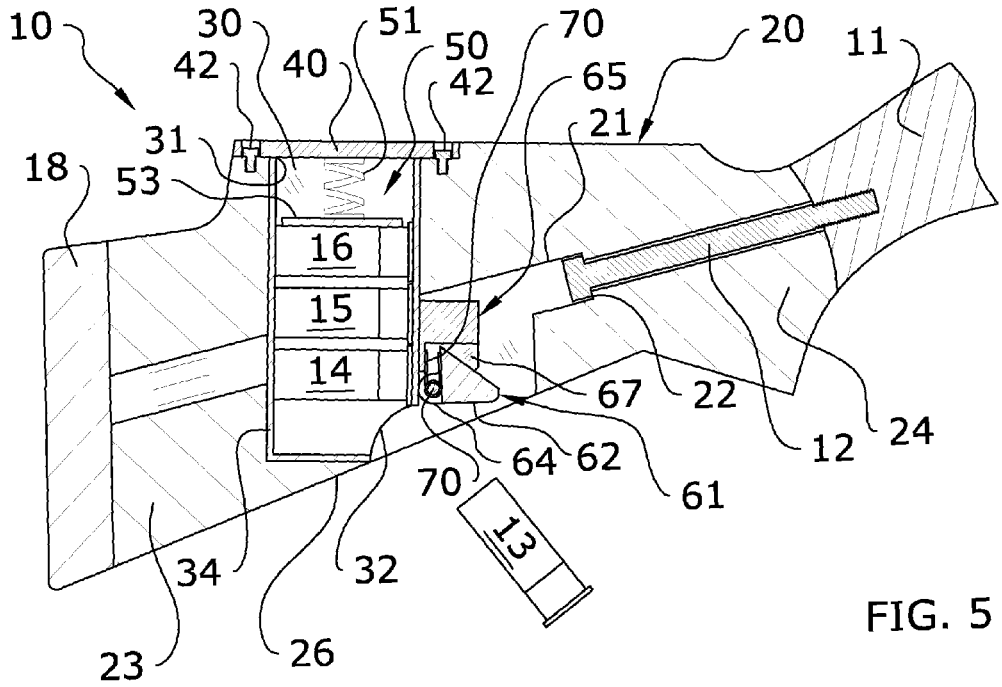
FIG. 5 is a sectional view of the present invention showing the lower retaining arm pivoting upwardly such as to release the lowermost ammunition cartridge.

The lower retaining arm 61 generally comprises a side edge 62, an upper edge 63, and a connecting portion 64 extending upwardly from the connecting edge 63. The side edge 62 being vertical in the retaining position of the lower retaining arm 61 and the connecting edge 63 being horizontal in the retaining position and extending forwardly within the cavity 27 from the top of the side edge 62 as illustrated in FIG. 3. The side edge 62 rests against the forward wall of the casing 34 of the internal magazine 30. The lower end of the side edge 62 of the lower retaining arm 61 preferably does not extend to the bottom of the reload/discharge opening 32 such that a forward, lower corner of the lowermost ammunition cartridge 13 is left exposed for an operator to grasp as illustrated by the exposed portion 29 between the lower end of the lower retaining arm 61 and the lower support 26. As illustrated in FIG. 5, the retaining edge 62 is horizontal in the open position and the edge 63 is vertical in the open position.

The upper retaining arm 65 generally comprises a side edge 66, a forward recess 67, and a connecting portion 68. The connecting portion 68 of the upper retaining arm 65 generally connects to the second biasing element 70 and may overlap the connecting portion 64 of the lower retaining arm 61. The side edge 66 of the upper retaining arm 65 extends vertically upwards from the side edge 62 of the lower retaining arm 61. Both the side edge 66 and the side edge 62 share a common rear edge that rests against the forward wall of the casing 34 of the internal magazine 30, wherein the upper retaining arm 65 is generally positioned above the lower retaining arm 61.

Figure 4:
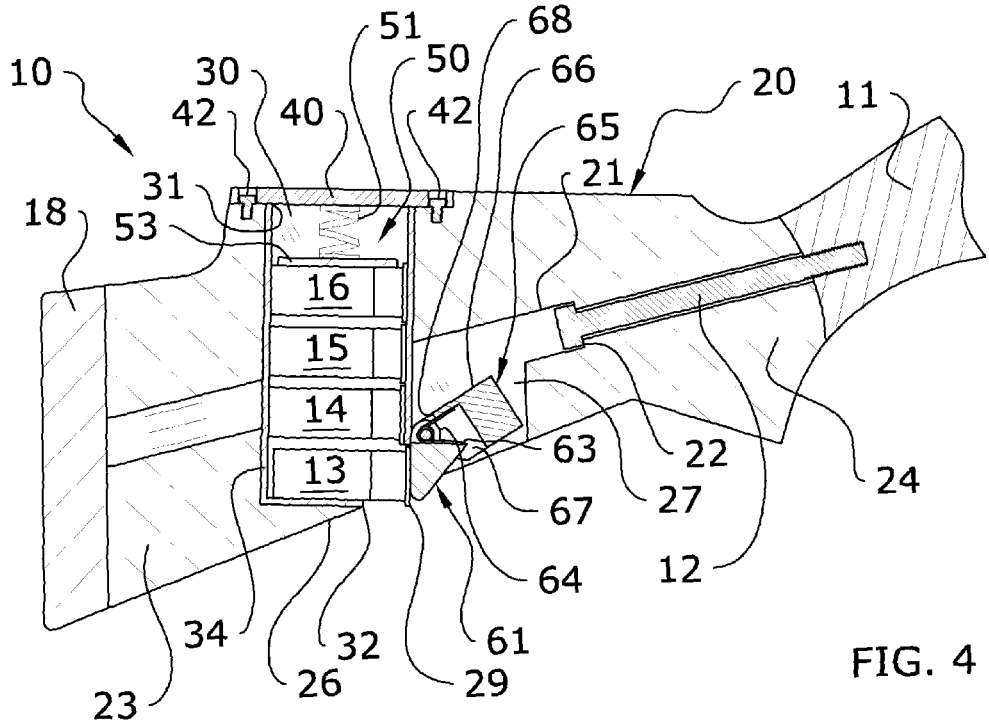
FIG. 4 is a sectional view of the present invention showing the firearm being discharged such as to cause the upper retaining arm to pivot downwardly.

The forward recess 67 is formed on the lower forward corner of the upper retaining arm 65 and regulates the degree that the retaining arm 65 is able to pivot in a downward manner when the firearm is shot or discharged as illustrated in FIG. 4 and also receives the lower retaining arm 61 when pivoting upwardly to release a cartridges 13-16 as illustrated in FIG. 5. The lower retaining arm 61 is unable to pivot rearwardly because of the presence of ammunition cartridges 13-16 within the magazine 30 and thus the upper retaining arm 65 is stopped from downward pivotal movement when engaging the lower retaining arm 61.

F. Operation of Preferred Embodiment.

In use, the magazine 30 is loaded with ammunition cartridges 13-16 generally through the reload/discharge opening 32. The first biasing assembly 50 is caused to engage the uppermost ammunition cartridge 16 and apply downward pressure thereon, thus ensuring that the ammunition cartridges 13-16 remain properly stacked within the magazine 30 as illustrated in FIG. 3.

When the lowermost ammunition cartridge 13 is desired to be removed from the magazine 30, the exposed forward and lower corner of the lowermost ammunition cartridge 13 via the exposed portion 29 is grasped and pulled forwardly. The exposed portion 29 is large enough and is purposely located at a corner of the ammunition cartridge for permitting the operator to easily grasp the ammunition cartridge with gloved-hands. Forward movement of the ammunition cartridge 13 causes the lower retaining arm 61 to rotate forwardly and upwardly and into the cavity 27, thus compressing the second biasing element 70 (i.e. tension spring) as illustrated in FIG. 5.

Figure 6:
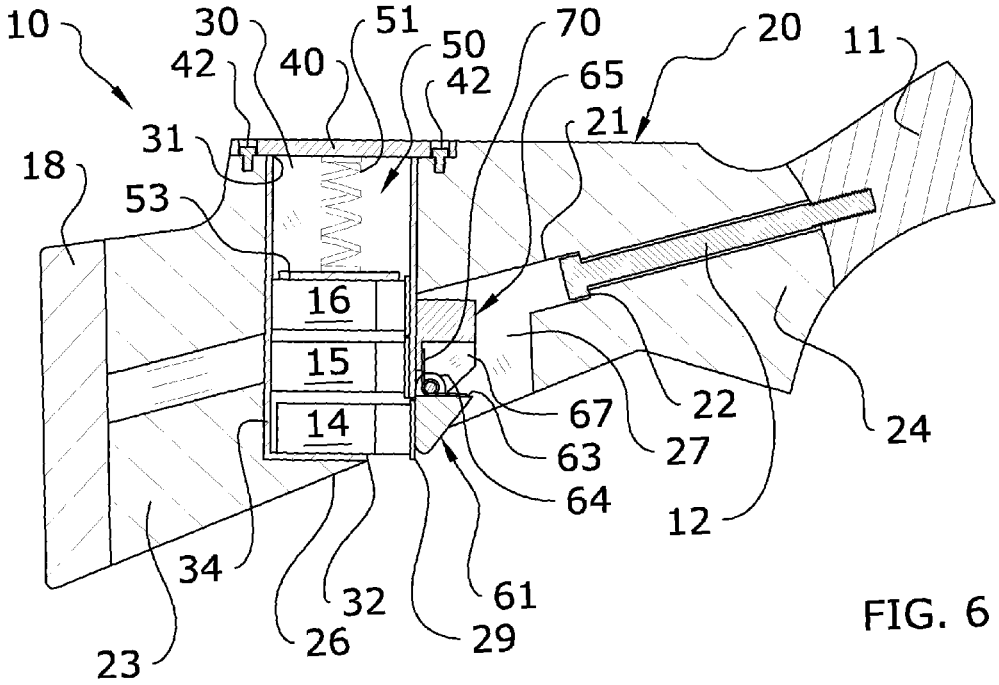
FIG. 6 is a sectional view of the present invention showing the remaining ammunition cartridges being forced downwardly within the magazine.

As the ammunition cartridge 13 is pulled forward and out the first biasing assembly 50 including the second biasing element 70 and follower element 53 push down on the reserve ammunition cartridges 14-16 within the magazine 30 until the lowermost cartridge 14 of the remaining ammunition cartridges 14-16 engages the lower support 26 as illustrated in FIG. 6. The lower retaining arm 61 also maintains pressure upon the ammunition cartridge 13 being removed to ensure steady removal of the ammunition cartridge 13. After removal, the removed ammunition cartridge 13 is now ready to reload the empty chamber of the firearm (e.g. shotgun, rifle, etc.) and the lower retaining arm 61 returns to an initial position, thus being substantially vertical to close the reload/discharge opening 32 and retain the remaining ammunition cartridges 14-16 within the magazine 30. The bore 21 is not typically used in the rifle embodiment of the firearm with the gunstock 20; however the bore 21 is used when the firearm is comprised of a shotgun embodiment.

By permitting the ammunition cartridges 14-16 to be removed from the bottom of the gunstock 20, the present invention permits ambidextrous use, wherein either left or right-handed operators may comfortably remove the ammunition cartridges 14-16. Also by permitting the ammunition cartridges 14-16 to be removed forwardly, the ammunition cartridges 14-16 are easily and fluidly transferred to the chamber of the firearm.

Discharging the firearm often results in significant recoil force. The recoil force causes the upper retaining arm 65 to rotate downwards and forwardly towards the lower retaining arm 61, which increases the tension of the second biasing element 70 thus holding the lower retaining arm 61 in position which ensures that the remaining ammunition cartridges 14-16 are retained within the magazine 30 and that the lower retaining arm 61 does not pivot forwardly as illustrated in FIG. 4.

It is appreciated that the mass of the upper retaining arm 65 is varied with the type of firearm and amount of recoil force the firearm outputs. In the preferred embodiment the upper retaining arm 65 is considerably heavier than the lower retaining arm 61. The lower retaining arm 61 is generally comprised of aluminum or other lightweight material that would permit the lower retaining arm 61 to easily pivot forwardly when the user removes ammunition cartridges 13-16. Because of the lightweight of the lower retaining arm 61, the upper retaining arm 65 is needed to retain the lower retaining arm 61 in a retaining position when the firearm is discharged such as to hold back the ammunition cartridges 13-16 within the magazine 30.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A gunstock system, comprising: a gunstock having an internal magazine, said internal magazine being substantially vertically oriented such that an upper end of said internal magazine is located near a top of said gunstock and a lower end of said internal magazine is located at a bottom of said gunstock and wherein said internal magazine has an exposed reload/discharge opening, wherein said exposed reload/discharge opening is located at said lower end of said internal magazine and is configured for allowing removal of an ammunition cartridge from said bottom of said gun stock; a first biasing means extending within said internal magazine from an upper end of said internal magazine and being adapted for applying a downward force upon one or more ammunition cartridges within said internal magazine; and a second biasing means supported adjacent said lower end of said internal magazine and being configured for adjusting to an open position and a closed position relative said exposed reload/discharge opening such as to permit removal of the ammunition cartridge from said exposed reload/discharge opening in said open position and to restrict removal of the ammunition cartridge from said exposed reload/discharge opening in said closed position.

2. The gunstock system of claim 1, wherein said first biasing means includes a biasing element and a follower element, wherein said follower element is attached to a terminal end of said biasing element to make contact with the ammunition cartridges.

3. The gunstock system of claim 2, wherein said biasing element is comprised of at least one spring.

4. The gunstock system of claim 1, wherein said gunstock includes a lower support, wherein said lower support is positioned beneath said internal magazine such as to restrict vertical ejection of the ammunition cartridges.

5. The gunstock system of claim 4, wherein said gunstock includes a lower cavity, wherein said second biasing means is positioned within said lower cavity and including an exposed portion between said lower support and said second biasing means, said exposed portion being adapted for grasping an ammunition cartridge within said magazine.

6. The gunstock system of claim 5, wherein said second biasing means has a rearward edge, said rearward edge forms a movable forward wall of said internal magazine over a portion of said reload/discharge opening such as to permit forward ejection of the ammunition cartridges via adjustment of said second biasing means from said closed position to said open position.

7. The gunstock system of claim 6, wherein said second biasing means comprises:

an upper retaining arm;

a lower retaining arm, wherein said upper retaining arm and said lower retaining arm collectively form said rearward edge; and a tension spring connected to both said upper retaining arm and said lower retaining arm such that a pivotal movement of said upper retaining arm and/or said lower retaining arm causes said tension spring to compress.

8. The gunstock system of claim 7, wherein said lower retaining arm extends partially over said reload/discharge opening such that at least a portion of said reload/discharge opening is left exposed, and wherein said second biasing means is in said closed position when said lower retaining arm is vertically-oriented and wherein said second biasing means is in said open position when said lower retaining arm is horizontally-oriented.

9. The gunstock system of claim 8, wherein said upper retaining arm is connected to said lower retaining arm via said tension spring such that a downward and forward pivotal movement of said upper retaining arm exerts a rearward force upon said first retaining arm via said tension spring.

10. The gunstock system of claim 1, including an operable cover connected to said gunstock for operatively opening and closing over an upper opening of said internal magazine, said upper opening being located at said upper end of said internal magazine.

11. The gunstock system of claim 10, wherein said first biasing means extends from said operable cover.

12. The gunstock system of claim 1, wherein said gunstock includes a bore extending therethrough, wherein said bore is adapted to receive a bolt for connection of said gunstock to a firearm.

13. A gunstock system, comprising:

a gunstock having a lower support, an internal cavity, and a substantially vertically-oriented internal magazine such as for retaining ammunition cartridges therein in a vertically-stacked orientation;

wherein said internal magazine has a lower, reload/discharge opening for receiving the substantially horizontally-oriented ammunition cartridges and also for ejecting the ammunition cartridges in a substantially forward direction;

wherein said lower support forms a bottom of said internal magazine and wherein said internal cavity is positioned forwardly of said internal magazine, wherein said reload/discharge opening leads to said internal cavity;

wherein said internal magazine angles rearwardly at a lower end;

a first biasing assembly extending within said internal magazine to apply a downward pressure upon the ammunition cartridges;

a second biasing assembly connected to said gunstock and positioned within said internal cavity, wherein said second biasing assembly adjusts to an open position and a closed position relative said reload/discharge opening such as to permit removal of an ammunition cartridge from said reload/discharge opening in said open position and to restrict removal of the ammunition cartridge from said reload/discharge opening in said closed position.

14. The gunstock system of claim 13, wherein said first biasing assembly includes a biasing element and a follower element, wherein said follower element is attached to a terminal end of said biasing element to make contact with the ammunition cartridges.

15. The gunstock system of claim 14, wherein said biasing element is comprised of at least one spring.

16. The gunstock system of claim 13, wherein said second biasing means has a rearward edge, said rearward edge forms a movable forward wall of said internal magazine such as to permit forward ejection of the ammunition cartridges via adjustment of said second biasing means from said closed position to said open position.

17. The gunstock system of claim 16, wherein said second biasing means comprises:

an upper retaining arm;

a lower retaining arm, wherein said upper retaining arm and said lower retaining arm collectively form said rearward edge; and a tension spring connected to both said upper retaining arm and said lower retaining arm such that a pivotal movement of said upper retaining arm and/or said lower retaining arm causes said tension spring to compress.

18. The gunstock system of claim 17, wherein said lower retaining arm extends partially over said reload/discharge opening such that at least a portion of said reload/discharge opening is left exposed, and wherein said second biasing means is in said closed position when said lower retaining arm is vertically-oriented and wherein said second biasing means is in said open position when said lower retaining arm is horizontally-oriented.

19. The gunstock system of claim 18, wherein said upper retaining arm is connected to said lower retaining arm via said tension spring such that a downward and forward pivotal movement of said upper retaining arm exerts a rearward force upon said first retaining arm via said tension spring.

20. A gunstock system, comprising:

a gunstock having a lower support, an internal cavity, and a substantially vertically-oriented internal magazine such as for retaining ammunition cartridges therein in a vertically-stacked orientation;

wherein said internal magazine has an upper opening;

wherein said internal magazine has a lower, reload/discharge opening for receiving the substantially horizontally-oriented ammunition cartridges and also for ejecting the ammunition cartridges in a substantially forward direction;

wherein said lower support forms a bottom of said internal magazine and wherein said internal cavity is positioned forwardly of said internal magazine, wherein said reload/discharge opening leads to said internal cavity;

wherein said gunstock includes a bore extending therethrough, wherein said bore is adapted to receive a bolt for connection of said gunstock to a firearm;

an operable cover connected to said gunstock for closing said upper opening;

a first biasing assembly extending from said cover, wherein said first biasing assembly extends within said internal magazine;

wherein said first biasing assembly includes a biasing element and a follower element, wherein said follower element is attached to a terminal end of said biasing element to make contact with the ammunition cartridges;

wherein said biasing element is comprised of at least one spring; and a second biasing assembly connected to said gunstock and positioned within said internal cavity, wherein said second biasing assembly adjusts to an open position and a closed position relative said reload/discharge opening such as to permit removal of an ammunition cartridge from said reload/discharge opening in said open position and to restrict removal of the ammunition cartridge from said reload/discharge opening in said closed position;

wherein said second biasing means has a rearward edge, said rearward edge forms a movable forward wall of said internal magazine over a portion of said reload/discharge opening such as to permit forward ejection of the ammunition cartridges via adjustment of said second biasing means from said closed position to said open position;

wherein said second biasing means comprises an upper retaining arm, a lower retaining arm, wherein said upper retaining arm and said lower retaining arm collectively form said rearward edge, and a tension spring connected to both said upper retaining arm and said lower retaining arm such that a pivotal movement of said upper retaining arm and/or said lower retaining arm causes said tension spring to compress;

wherein said lower retaining arm extends partially over said reload/discharge opening such that at least a portion of said reload/discharge opening is left exposed, and wherein said second biasing means is in said closed position when said lower retaining arm is vertically-oriented and wherein said second biasing means is in said open position when said lower retaining arm is horizontally-oriented;

wherein said upper retaining arm is connected to said lower retaining arm via said tension spring such that a downward and forward pivotal movement of said upper retaining arm exerts a rearward force upon said first retaining arm via said tension spring.

* * * * *